US006889458B2

(12) United States Patent
Copley

(10) Patent No.: US 6,889,458 B2
(45) Date of Patent: May 10, 2005

(54) FLEXIBLE ARTWORK DISPLAY SYSTEM

(76) Inventor: John S. Copley, 4 Stoneybrook Rd., Hopkinton, MA (US) 01748

( * ) Notice: Subject to any disclaimer, the term of this patent is extended or adjusted under 35 U.S.C. 154(b) by 139 days.

(21) Appl. No.: 10/230,498

(22) Filed: Aug. 29, 2002

(65) Prior Publication Data

US 2004/0040195 A1 Mar. 4, 2004

(51) Int. Cl.[7] ..... A47G 1/06
(52) U.S. Cl. ..... 40/711; 40/600
(58) Field of Search ..... 40/711, 600, 800; 24/306

(56) References Cited

U.S. PATENT DOCUMENTS 3,786,584 A * 1/1974 Holson ..... 40/711 X
3,885,336 A * 5/1975 Olsen ..... 40/711
3,897,645 A * 8/1975 Scheyer ..... 40/800
4,271,566 A * 6/1981 Perina ..... 24/306 X
4,356,650 A * 11/1982 Antonczyk et al. ..... 40/800
5,172,503 A * 12/1992 Dane et al. ..... 40/600
5,806,223 A 9/1998 Visagie
5,893,229 A 4/1999 Werner
6,572,945 B2 * 6/2003 Bries ..... 24/306 X

* cited by examiner

*Primary Examiner*—Joanne Silbermann
(74) *Attorney, Agent, or Firm*—Guerin & Rodriguez, LLP; Michael Rodriguez

(57) ABSTRACT

An artwork display system is described. The display system includes a backing board having a surface, artwork having a back surface, and an attachment device having a first planar portion and a second planar portion. The first planar portion is affixed to the surface of the backing board and the second planar portion is affixed to the back surface of the artwork. The first planar portion is detachably connected to the second planar portion.

18 Claims, 4 Drawing Sheets

FLEXIBLE ARTWORK DISPLAY SYSTEM

FIELD OF THE INVENTION

The invention relates generally to artwork display systems. More particularly, the invention relates to artwork display systems with detachable features that promote and facilitate modifications to artwork on display.

BACKGROUND

For as long as there have been bare walls there have been wall decorations. A common technique for adorning walls is to hang artwork within frames. Often the frames are an integral part of the artwork. For various reasons, the moment arrives to change the artwork. For instance, the novelty or fascination with the currently hanging artwork fades over time, the artwork becomes dated or out of season, or the decorator changes the theme or color scheme of a particular office or room and the artwork no longer fits the new scheme. In such situations, the decorator is faced with removing the artwork, including the frame, for disposal or storage in such places as a closet, garage, or attic. Generally, a new piece of artwork within a new frame replaces the retired artwork. The inconvenience and expense of this technique typically discourage its practice, and in many homes and offices the old artwork remains on the wall, where it no longer delights the occupant or agrees with the decor.

SUMMARY

In one aspect, the invention features an artwork display system having a backing board with a surface, artwork with a back surface, and an attachment device that has a first planar portion and a second planar portion. The first planar portion is affixed to the surface of the backing board and the second planar portion is affixed to the back surface of the artwork. The first planar portion is detachably connected to the second planar portion.

In another aspect, the invention features an artwork display system comprising a backing board having a surface, a spacer having a front surface that is connected to the backing board, artwork having a back surface, and a first attachment device having a first planar portion and a second planar portion. The first planar portion is affixed to the back surface of the artwork and the second planar portion is affixed to the front surface of the spacer. The first planar portion is detachably connected to the second planar portion to detachably connect the artwork to backing board by the spacer.

In yet another aspect, the invention features a flexible artwork display system, comprising artwork having a viewing side and a back surface, spacer means having a front surface and back surface, a frame having a groove formed therein, means for vertically supporting the artwork, a first attachment means permanently affixed to one of the back surface of artwork and the front surface of the spacer means, and a second attachment means permanently affixed to one of the back surface of the spacer means and the front surface of the means for vertically supporting the artwork. The vertical support means is slidably engaged in the groove of the frame. The first attachment means detachably connects the back surface of the artwork to the front surface of the spacer means and the second attachment means connects the back surface of the spacer means to the front surface of the means for vertically supporting the artwork.

BRIEF DESCRIPTION OF THE DRAWINGS

The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

DETAILED DESCRIPTION

Figure 1A:
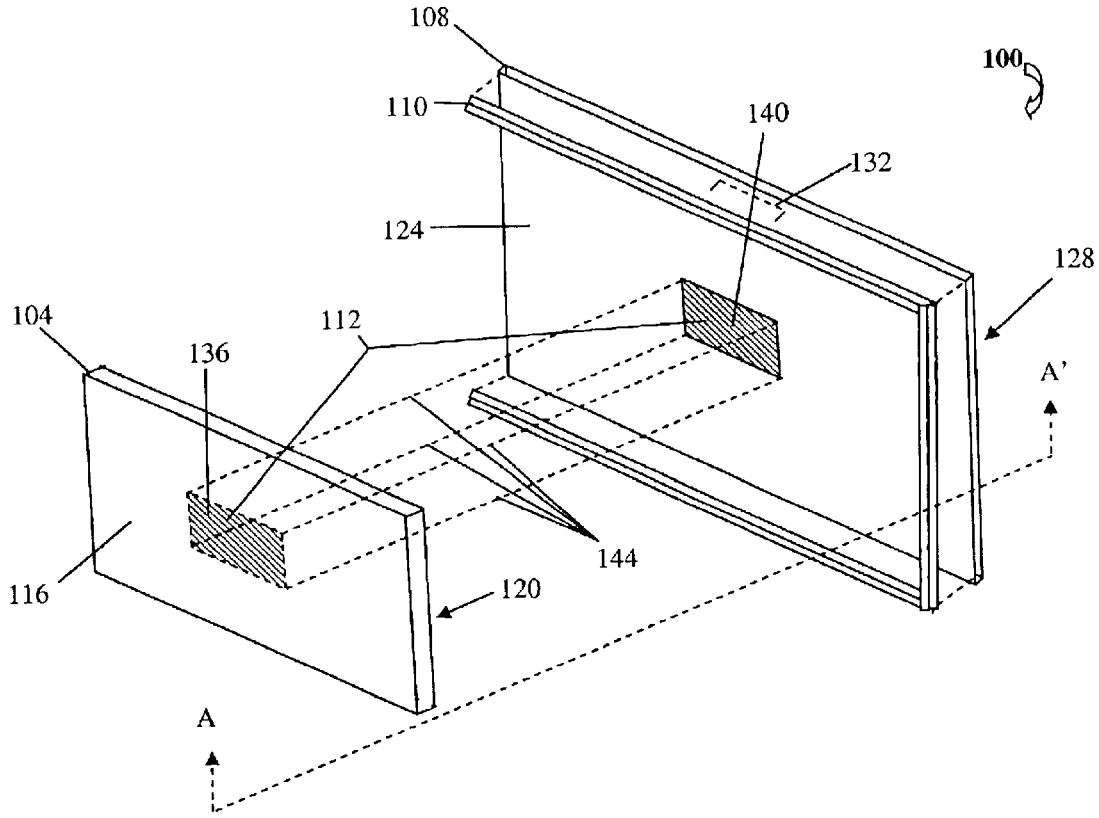
FIG. 1A is an exploded view of an embodiment of an artwork display system of the invention.

FIG. 1A shows an exploded view of an embodiment of an artwork display system 100 constructed in accordance with the principles of the invention. The artwork display system 100 is useful for vertically displaying artwork in a variety of ways, for example, by hanging from vertical surfaces such as doors and walls, by suspending from a horizontal surface such as a ceiling, and by supporting on a stand, such as an easel. The artwork display system 100 includes artwork 104 and a backing board (or mounting board) 108. Optionally, the artwork display system 100 includes a frame 110 (e.g., metal, wood) connected to the periphery of the backing board 108 to enclose the artwork 104. In general, the thickness of the frame 110 depends upon the particular framing treatment embodied by the artwork display system 100. Shadow boxes, for example, have thicker frames in general, but not necessarily, than photographs or paintings.

An attachment device 112 detachably connects the artwork 104 with the backing board 108. Because the artwork 104 is detachably connected to the backing board 108, a person can change the artwork 104 as frequently as desired, typically without having to remove the backing board 108, for example, from the wall. Similarly, the person can change the backing board 108 independently of the artwork 104. Accordingly, the invention provides flexibility to previously inflexible framing treatments such as shadow boxes and framed photographs and paintings. For the purpose of simplifying a description of the invention, only one piece of artwork 104 is shown, but it is to be understood that the principles of the invention apply also to a plurality of pieces of artwork 104 connecting to the same backing board 108.

Embodiments of the artwork display system 100 vary widely with respect to dimensions. The invention applies to small artwork display systems such as shadow boxes for displaying small articles such as photographs, postcards, pictures, and certificates of awards, and to large artwork display systems for displaying large presentations, such as posters and billboards. Thus, the range of dimensions of artwork display systems embodying the invention varies from a few square inches to several square feet.

Artwork 104 is herein used to describe the article, item, or object to be displayed and its supporting structure, if any, such as a substrate, an acrylic frame, or a board. Acrylic frames, for example, are available in a wide variety of sizes, such as 16"×20", 20"×30", and 5"×7", to list but a few, for receiving photographs with like dimensions. The artwork 104 includes a front surface 116 and a back surface 120. The front surface 116 of the artwork 104 is a viewing side that an observer sees when the artwork display system 100 is vertically displayed.

Examples of artwork 104 include a "white board" upon which a person can write using an erasable marker or attach magnetic objects and a cork board into which a person can pin photographs and other papers and images. Another example of artwork 104 is a photograph inserted between the transparent panels of an acrylic frame.

In one embodiment, the artwork 104 includes a substrate called CELTEC™, which is manufactured by Vycom of Scranton, Pa. In one embodiment, a digital image is superimposed onto the substrate to produce a viewing side. In other embodiments, posters and photographs are adhesively attached to a surface of the substrate to produce a viewing side. In other embodiments (not shown), the artwork 104 includes an object, such as a medallion, a certificate of award (i.e., ribbons), and seasonal craftwork (e.g., a Christmas wreath).

The backing board 108 includes a front surface 124 and a back surface 128. Each of the front and back surfaces 124, 128 can have one or more colors and patterns. The color or pattern on the front surface 124 can be the same as or different from that of the back surface 128. In general, the backing board 108 is material such as ferrous, mat-board, or foam-core board that supports the artwork 104 for vertically displaying, for example, by hanging or mounting on a wall. Generally, the backing board 108 is lightweight and portable, enabling a person to move the artwork display system 100 easily from one location to another. Typically, the dimensions of the backing board 108 are larger than that of the artwork 104 to create a background for the artwork 104.

In one embodiment, the backing board 108 slides into a groove (FIG. 1B) within the frame 110. Accordingly, the backing board 108 is removable and replaceable with a different backing board 108. A portion of the frame 110 is removable (preferably at the top) to permit insertion of the backing board into the groove. Or, if the backing board 108 has differently colored or patterned front and back surfaces 124, 128, the backing board 108 can be removed, turned, and reinserted into the groove to provide a different colored background for the artwork 104.

One type of material for constructing the backing board 108 is CELTEC, manufactured by Vycom of Scranton, Pa. A ferrous backing board capable of attracting and holding magnets and magnet sheets is another type of material useful in practicing the invention. Some embodiments have backing boards that are in a range from ⅛" thick to ½" thick. Thicker or thinner backing boards are possible without departing from the principles of the invention.

Typically, the backing board 108 includes a mounting device 132 (shown in phantom) on the back surface 128 of the backing board 108. Alternatively, the mounting device 132 can be attached to and extend from a back surface of the frame 132. In general, the mounting device 132 enables the artwork display system 100 to be mounted on a vertical surface such as a wall, door, or fence, or suspended from a horizontal surface. In one embodiment, the mounting device 132 is a magnet sheet for attaching the backing and display on a metallic surface, such as a refrigerator door, filing cabinet, or locker. In other embodiments, the mounting device 132 is a hook, wire, or bracket for hanging the display system 100, for example, on a nail. In yet another embodiment, the mounting device 132 comprises one or more loops through which rope, chain, or wire can pass for suspending the artwork display system 100. Other types of mounting devices and positions on the backing board 108 or the frame 110 are possible without departing from the principles of the invention.

The backing board 108 can also have at least one hole therein. The hole can be used to receive an electrical cord by which electricity can be provided to the artwork display system 100. The electricity can be used for a variety of purposes, such as for powering a lighting arrangement (e.g., a light bulb or a string of lights) within artwork display system 100. The hole or holes can also operate to allow penetration of light from a light source placed behind the artwork display system 100.

As described above, the attachment device 112 detachably connects the artwork 104 to the backing board 108. In one embodiment, the attachment device 112 includes a first planar portion 136 and a second planar portion 140 to which the first planar portion 136 detachably attaches. The sizes and thicknesses of the planar portions determine the strength of attachment between the planar portions 136, 140. The sizes of the planar portions 136, 140 in FIG. 1A are exemplary. The principles of the invention apply to other sizes. For example, the second planar portion 140 can have approximately the same dimensions as the backing board 108. Thus, one or more pieces of artwork 104 can be connected to almost any location on the backing board 108, not just in the backing board center as shown in FIG. 1A.

The dashed lines 144 in FIG. 1A indicate the connection and alignment between the first second planar portions 136, 140. Exact alignment between the planar portions 136, 140 is not necessary for the planar portions 136, 140 to adhere sufficiently to each other to hold the artwork 104 in place on the backing board 108 while vertically displaying the artwork 104.

In one embodiment, one of the planar portions 136, 140 of the attachment device 112 is a sheet of rubber steel and the other of the planar portions 140, 136 is a magnet sheet. Such an attachment device is manufactured by the Rochester Magnet Company of E. Rochester, N.Y. One side of the sheet of rubber steel and one side of the magnet sheet each have an adhesive for permanently affixing the sheets to a surface. (Permanent affixing or attachment means a connection not intended to be detached or, if detached, one that can cause damage to a surface and the reusability of the attachment device.) The placement of the magnet sheet can be either on the back surface 120 of the artwork 104 or on the front surface 124 of the backing board 108, provided the rubber steel sheet is on the other of these surfaces and able to make sufficient contact with the magnet sheet to secure the artwork 104 for vertical display. Rubber and magnetic sheets are available in colors, which can be useful in treatments where the sheet attached to the backing board 108 has larger dimensions than the artwork 104 and therefore is visible to a viewer.

The strength of the attachment depends upon the sizes and thicknesses of the magnetic and rubber steel sheets and the overlap between them when connected to each other. Generally, larger and thicker sheets provide greater attachment strength. For example, a magnet sheet with a 0.030 mil thickness has greater attachment strength than a magnet sheet with a 0.015 mil thickness. Considerations as to the weight of the artwork 104 to be displayed and the desired level of ease for changing artwork 104 goes to determine the size and thickness of the sheets for the particular project. To change the artwork 104, a person pulls the artwork 104 with sufficient force to detach the magnetic connection between the planar portions 136, 140 and substitutes a different artwork 104 with the appropriate type of planar portion (i.e., a rubber steel sheet if the backing board 108 has a magnetic sheet, or a magnetic sheet if the backing board has a rubber steel sheet). An advantage of this particular type of attachment device 112 is that the user can slide the artwork 104 along the front surface 124 of the backing board 108 after connecting the planar portions 136, 140, thus permitting the user to adjust the alignment between the artwork 104 and the backing board 108 after the initial attachment.

In another embodiment, one of the planar portions 136, 140 of the attachment device 112 is a sheet of VELCRO™ and the other of the planar portions 140, 136 is a mating counterpart to the sheet of VELCRO™.

In some embodiments (not shown), the attachment device 112 does not have one or both of the planar portions 136, 140. For example, in one embodiment the attachment device 112 includes a mounting device, such as a hook and wire. For example, the wire is securely attached to and extends across the back surface 120 of the artwork 104 and the hook extends from the front surface 124 of the backing board 108. When detachably attaching the artwork 104 to the backing board 108, a person drapes the wire over the hook to hang the artwork 104. To change the artwork 104, a person lifts the wire from off the hook and substitutes a different artwork 104 with a wire attached on the back surface thereof. Other embodiments have the wire attached to the backing board 108 and the hook attached to the artwork 104.

As another example, in one embodiment the attachment device 112 is a magnet or magnet sheet having an adhesive on one side for permanent attachment to the artwork 104 or to the backing board 108. For this particular embodiment, the attachment device 112 does not have a corresponding mating portion on the other component (i.e., artwork 104 or backing board 108). For embodiments in which the attachment device 112 is affixed to the back surface 106 of the artwork 104, at least a portion of the front surface 124 of the backing board 108 is ferrous or metallic so that the artwork 104 can magnetically adhere to the backing board 108. For embodiments in which the attachment device 112 is affixed to the front surface 124 of the backing board 108, at least a portion of the back surface 106 of the artwork 104 is ferrous or metallic so that the attachment device 112 on the backing board 108 can magnetically adhere to the artwork 104. In these embodiments, the artwork 104 and backing board 108 together are light enough to be carried and vertically displayed wherever desired.

Figure 1B:
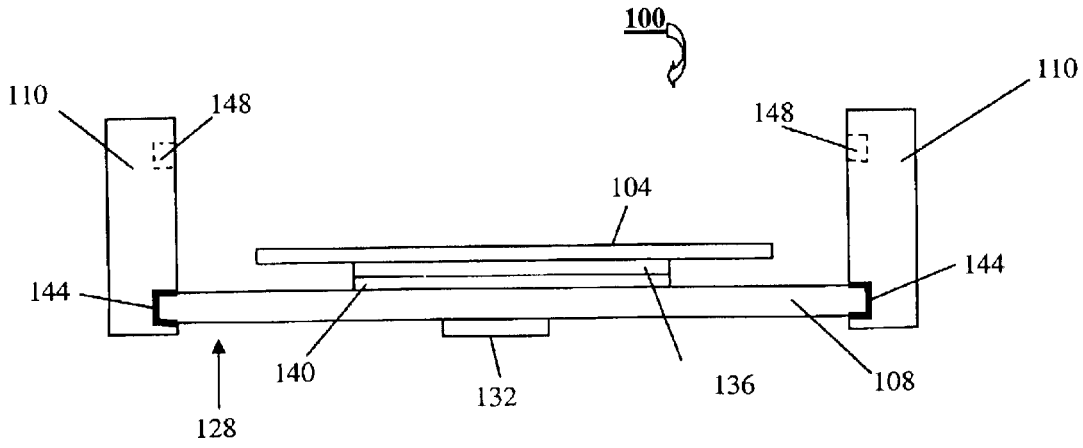
FIG. 1B is a cross-sectional view of the artwork display system shown in FIG. 1A.

FIG. 1B shows a cross-sectional view of an embodiment of the artwork display system 100 in FIG. 1A. The cross-section is along the line AA' in FIG. 1A. The artwork 104 is connected to the first planar portion 136 and the backing board 108 is connected to the second planar portion 140. The first planar portion 136 is detachably connected to the second planar portion 140 to permit detachment of the artwork 104 from the backing board 108. In the embodiment shown, the back surface 128 of the backing board 108 has the mounting device 132 for vertically displaying the artwork display system 100 on, for example, a hook, nail, or bracket extending from a vertical surface. The thicknesses of the first and second planar portions 136, 140 are exaggerated with respect to the artwork 104 and backing board 108 in order to more clearly illustrate the detachable connection between the artwork 104 and backing board 108. The backing board 108 is located within a groove 144 (bolded lines) in the frame 110. The frame 110 can also have another groove 148 (phantom lines) for slidably receiving and holding a transparent panel (e.g., glass or PLEXIGLAS™) to protect the artwork 104 from accidental or intentional misuse.

Figure 2A:
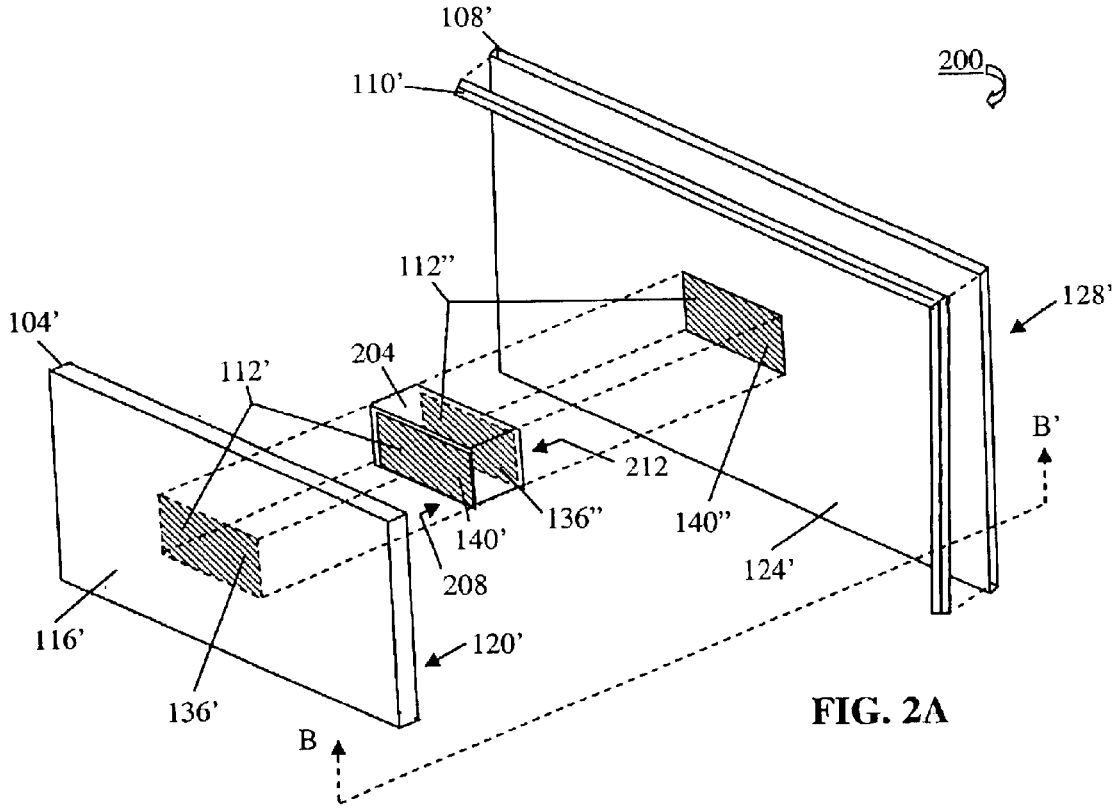
FIG. 2A is an exploded view of another embodiment of an artwork display system of the invention.

FIG. 2A shows an exploded view of another embodiment of an artwork display system 200 constructed in accordance with the principles of the invention. Features of the artwork display system 200 with reference numerals that are the same, but for the addition of the prime (') designation, as the reference numerals of corresponding features of the artwork display system 100 in FIG. 1A have similar construction, structure, and functionality as those corresponding features. The artwork display system 200 includes artwork 104', a backing board 108', and a spacer (or block) 204. Optionally, the artwork display system 200 includes a frame 110' attached around the periphery of the backing board 108'. As described above, the frame 110' can be used to support a PLEXIGLAS™ or glass panel that encases the artwork 104'.

The artwork 104' includes a front surface 116' and a back surface 120', the backing board 108' includes a front surface 124' and a back surface 128', and the spacer 204 includes a front surface 208 and a back surface 212. The spacer 204 is made of material such as a ferrous, mat-board, or foam-core board and achieves an element of depth in the artwork display system 200 by placing some space between the artwork 104' and the backing board 108'. In one embodiment, the spacer 204 is a ½" thick, 8"×12" piece of GATORFOAM. GATORFOAM is manufactured by Coda, Inc. of Mahwah, N.J. Other embodiments of the spacer 204 use a variety of different thicknesses and dimensions without departing from the principles of the invention. In general, the spacer 204 has smaller dimensions than the artwork 104 (i.e., smaller in width and in length). It is to be understood that some embodiments of the artwork display system 200 have a plurality of spacers 204 with various thicknesses and dimensions, as described below in connection with FIG. 3B.

A first attachment device 112' includes a first planar portion 136' and a second planar portion 140' to which the first planar portion 136' detachably attaches. The first planar portion 136' is affixed to the back surface 120' of the artwork 104' and the second planar portion 140' is affixed to the front surface 208 of the spacer 204. In general, the attachments to the surfaces 120', 208 of the artwork 104' and spacer 204 are permanent (i.e., not intended to be detached or, if detached, with possible damage to the surface and reusability of the planar portion). For some embodiments, such attachments are not permanent. The first attachment device 112' detachably connects the artwork 104' to the spacer 204, thus permitting a person to change the artwork 104' as frequently as desired.

A second attachment device 112" includes a first planar portion 136" and a second planar portion 140" to which the first planar portion 136" detachably attaches. The first planar portion 136" is affixed to the back surface 212" of the spacer 204 and the second planar portion 140' is affixed to the front surface 124' of the backing board 108'. The second attachment device 112" detachably connects the spacer 204 to the backing board 108', thus permitting a person to change the spacer 204, for example, to increase or decrease the depth of the artwork 104' with respect to the backing board 108'. In one embodiment, the spacer 204 is "telescopic," that is, the spacer 204 is constructed such that the thickness is adjustable (i.e., increased by stretching and decreased by compressing the spacer 204). In this instance, a person can increase or decrease the spacing between the artwork 104' and the backing board 108' by pulling or pushing the artwork 104' outwards or inwards. Another technique for increasing the spacing between the artwork 104' and the backing board 108' is to use a stack of spacers 204 (with or without attachment devices between spacers 204).

In one embodiment, the strength of the attachment between the planar portions 136', 140' of the first attachment device 112' is less than the strength of the attachment of the planar portions 136", 140" of the second attachment device 112". The difference in attachment strengths permits the user to remove the artwork 104' from the spacer 204 without removing the spacer 204 from the backing board 108'. Further, a person can remove the artwork 104', and substitute another, without having to remove the backing board 108' from the wall.

Using magnet sheets of different thicknesses achieves different attachment strengths. For example, when first attachment device 112' includes a magnet sheet having a 0.015 mil thickness and the second attachment device 112" includes a magnet sheet having a 0.030 mil thickness, when a person pulls the artwork 104' to remove it from the artwork display system 200, the artwork 104' detaches from the spacer 204 without the spacer 204 detaching from the backing board 108'. If the first planar portion 136' on the back surface 120' of the artwork 104' is a magnet sheet, a person can place the artwork 104' on a metallic surface, such as a refrigerator door, where the artwork 104' remains on display, rather than store the artwork 104' where it cannot be seen.

Other embodiments use the other types of attachment devices described above in connection with FIG. 1A.

In some other embodiments, the spacer 204 is permanently affixed to one of either the artwork 104' or the backing board 108'. In these embodiments, one of attachment devices 112', 112" provides a permanent connection (i.e., attachment device 112' if the spacer 204 is affixed to the artwork 104' or attachment device 112" if affixed to the backing board 108'), and is thus not detachable as described above (i.e., with planar portions that detachably connect). Examples of this permanent attachment device include a glue, epoxy, hardware fastener, etc.

Figure 2B:
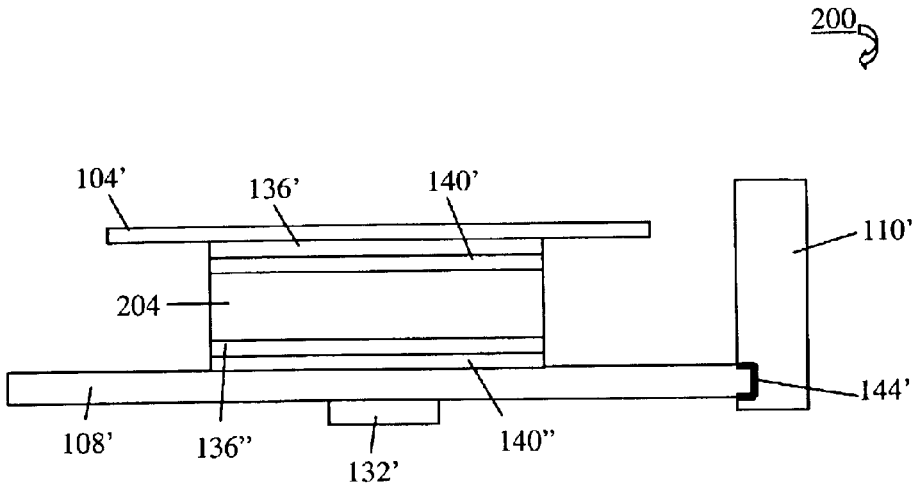
FIG. 2B is a cross-sectional view of the artwork display system shown in FIG. 2A.

FIG. 2B shows a cross-sectional view of an embodiment of the artwork display system 200 described in FIG. 2A. The cross-section is along the line BB' in FIG. 2A. The artwork 104' is connected to the first planar portion 136' of the first attachment device 112', the spacer 204 is connected to the second planar portion 140' of the first attachment device 112' and the first planar portion 136" of the second attachment device 112", and the backing board 108' is connected to the second planar portion 140" of the second attachment device 112". The first planar portion 136' of the first attachment device 112' is detachably connected to the second planar portion 140' of the first attachment device 112' to permit detachment of the artwork 104' from the spacer 204. Also, the first planar portion 136" of the second attachment device 112" is detachably connected to the second planar portion 140" of the second attachment device 112" to permit detachment of the spacer 204 from the backing board 108'. The back surface 128' of the backing board 108' has a mounting device 160' for hanging the artwork display system 200 on a hook, nail, or bracket extending from a vertical surface.

The thicknesses of the planar portions of the first and second attachment devices 112', 112" are not to scale in order to more clearly illustrate the detachable connections between the artwork 104' and spacer 204 and between the spacer 204 and the backing board 108'.

Figure 3A:
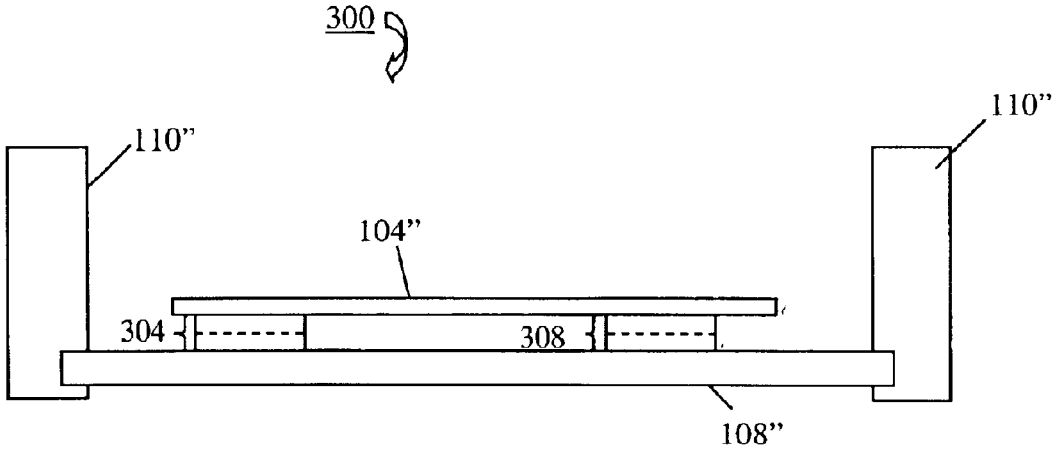
FIG. 3A is a cross-sectional view of another embodiment of an artwork display system of the invention.

FIG. 3A shows a cross-sectional view of another embodiment of an artwork display system 300. The cross-section is along a line similar to line AA' in FIG. 1A. This embodiment of the artwork display system 300 differs from the artwork display system 100 of FIG. 1A in that the artwork display system 300 includes a plurality of attachment devices 304, 308 that detachably connect the artwork 104" to the backing board 108". Optionally, the backing board 108" is within a groove 144" in a frame 110". In one embodiment, each attachment device 304, 308 is a single component permanently affixed to one of the artwork 104" or the backing board 108" and detachably connected to the other of the artwork 104" or the backing board 108". In another embodiment, shown with dashed lines, each attachment device 304, 308 includes a pair of planar portions detachably connected to each other and attached either to the artwork 104" or to the backing board 108".

Figure 3B:
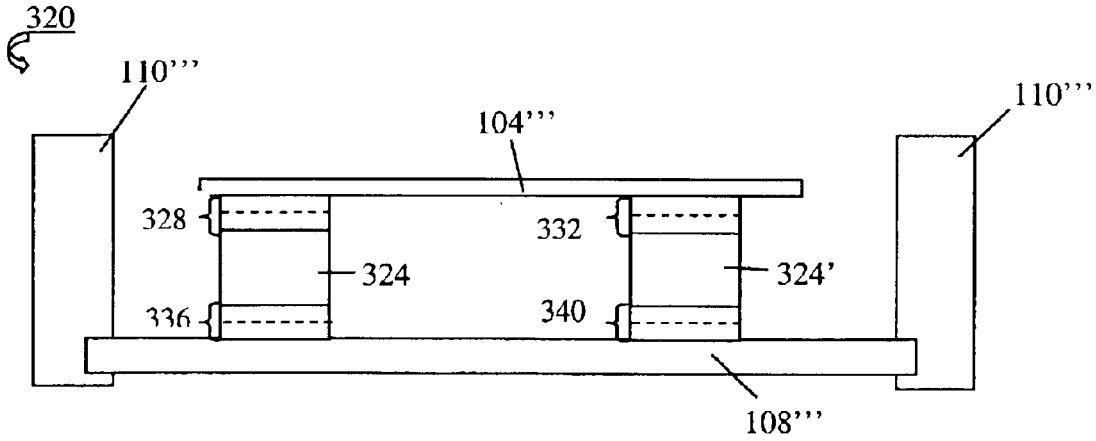
FIG. 3B is a cross-sectional view of another embodiment of an artwork display system of the invention having a plurality of spacers.

FIG. 3B shows a cross-sectional view of another embodiment of an artwork display system 320. The cross-section is along a line similar to line BB' in FIG. 2A. This embodiment of the artwork display system 320 differs from the artwork display system 200 of FIG. 2A in that the artwork display system 320 includes a plurality of spacers 324, 324' (generally spacer 324) and additional associated attachment devices that connect the artwork 104'" to the backing board 108'". When connecting to a single piece of artwork 104'", the spacers 324, 324' are generally of equal thickness, although not necessarily of equal width and length.

More specifically, the artwork 104'" is connected to a first spacer 324 by a first attachment device 328 and to a second spacer 324' by a second attachment device 332. The backing board 108'" is connected to the first spacer 324 by a third attachment device 336 and to the second spacer 324' by a fourth attachment device 340.

In one embodiment, each attachment device 328, 332, 336, 340 is a single component permanently affixed to one of the artwork 104'", the backing board 108'", or spacers 324, 324'. Each attachment device 328, 332, 336, 340 is also detachably connected to the appropriate one of the artwork 104'", the backing board 108'", or one of the spacers 324, 324'. For example, in an embodiment in which the attachment device 328 is permanently affixed to the artwork 104'", it is detachably connected to the spacer 324. In some embodiments, one or more of the attachment devices 328, 332, 336, 340 are not permanently affixed to any of the artwork 104'", backing board 108'", or spacers 324, 324'.

In another embodiment, shown with dashed lines, each attachment device 328, 332, 336, 340 includes a pair of planar portions detachably connected to each other and affixed (permanent or impermanent) to one of the artwork 104'", the backing board 108'", or spacers 324, 324'.

The plurality of spacers 324 can also be used to achieve various artistic effects. For example, rather than connect the same artwork 104'" to the backing board 108, the spacers 324 can each connect a different piece of artwork. Further, the spacers 324 can have different thicknesses. The different thicknesses can achieve a "terracing" effect in that artwork connected to a thicker spacer 324 is closer to the viewer than artwork connected to a thinner spacer. The overall effect is to achieve a sense of depth among the displayed artwork, with some artwork appearing in the foreground and some in the background.

Figure 4:
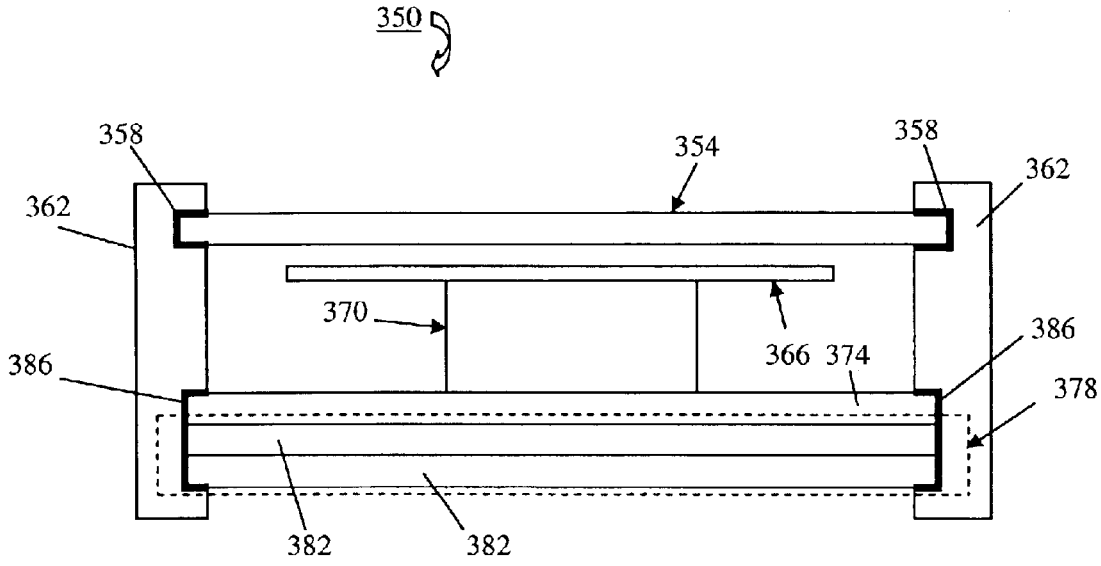
FIG. 4 is a cross-sectional view of an embodiment of an artwork display system with a storage feature for storing additional backing boards, glass, or artwork.

FIG. 4 shows a cross-sectional view of another embodiment of an artwork display system 350. The artwork display system 350 includes a removable transparent panel 354 (e.g., a pane of glass or PLEXIGLAS™) that is in a groove 358 of a frame 362. The groove 358 is appropriately sized to closely and slidably receive the transparent panel 354. A portion of the frame 362 is removable (preferably at the top of the display system 350) to permit insertion of the transparent panel 354 into the groove 358. In this embodiment, the artwork 366 is behind the transparent panel 354, detachably connected to a single spacer 370 and the spacer 370 is detachably connected to a backing board 374. It is to be understood that instead of a single piece of artwork 366 and a single spacer 370, the artwork display system 350 can have a plurality of terraced artwork 366 and spacers 370, as described above. Also, other embodiments connect artwork 366 directly to the backing board 374 without the use of any spacer(s) 370.

The artwork display system 350 also includes a storage area 378 (identified generally as a dotted box) for storing additional items 382, such as backing boards, transparent panels, and artwork. The storage area 378 includes a groove 386 (outlined in bold) in the frame 362. The groove 386 is sized and shaped for slidably receiving the backing board 374 and items 382 being stored. The removable portion of the frame 362 is removed to allow the backing board 374 and items 382 to be inserted into the groove 386.

In the embodiment shown, the storage area 378 is sized to hold two additional items 382. Other embodiments of the storage area 378 hold more or fewer items 382. The storage area 378 can also be formed as a plurality of adjacent separate grooves. Separate grooves allow each stored item 382 to be securely held in place although all of the storage area 378 is not currently being used to store an item 382.

In general, the storage area 378 provides a location for conveniently storing replacement backing boards, transparent panels, and artwork. Thus, when a person replaces the artwork 366, backing board 374, or both, the replaced item(s) can be slid into the storage area 378. Similarly, the replacements items can be those items previously stored in and retrieved from the storage area 378.

While the invention has been shown and described with reference to specific preferred embodiments, it should be understood by those skilled in the art that various changes in form and detail may be made therein without departing from the spirit and scope of the invention as defined by the following claims.

What is claimed is:

1. An artwork display system comprising:

a backing board having a surface;

a spacer having a front surface and a back surface connected to the backing board;

artwork having a back surface;

a first attachment device having a first planar portion and a second planar portion, the first planar portion being affixed to the back surface of the artwork and the second planar portion being affixed to the front surface of the spacer, the first planar portion being detachably connected to the second planar portion to detachably connect the artwork to the spacer; and a second attachment device that connects the back surface of the spacer to the surface of the backing board.

2. The artwork display system of claim 1, wherein the second attachment device has a first planar portion and a second planar portion, the first planar portion of the second attachment device being affixed to the back surface of the spacer and the second planar portion of the second attachment device being affixed to the surface of the backing board, the first planar portion of the second attachment device being detachably connected to the second planar portion of the second attachment device to detachably connect the spacer to the backing board.

3. The artwork display system of claim 2, wherein the spacer is detachably connected to the backing board with a greater strength than the artwork is detachably connected to the spacer.

4. The artwork display system of claim 2, wherein one of the first and second planar portions of the second attachment device is a rubber steel sheet and the other of the first and second planar portions of the second attachment device is a magnet.

5. The artwork display system of claim 2, wherein the first and second planar portions of the second attachment device are hook-and-loop elements.

6. The artwork display system of claim 1, wherein one of the first and second planar portions of the first attachment device is a rubber steel sheet and the other of the first and second planar portions of the first attachment device is a magnet.

7. The artwork display system of claim 1, wherein the first and second planar portions of the first attachment device are hook-and-loop elements.

8. The artwork display system of claim 1, wherein the backing board includes a back surface having a mounting device attached thereto for mounting the artwork and the backing board together on a vertical surface.

9. The artwork display system of claim 8, wherein the mounting device on the back surface of the backing board includes a magnet sheet for attaching the backing board to a metallic surface.

10. The artwork display system of claim 1, wherein the artwork includes a photograph.

11. The artwork display system of claim 1, further comprising a frame attached around a periphery of the backing board to frame the artwork.

12. A flexible artwork display system, comprising:

artwork having a viewing side and a back surface;

spacer means having a front surface and a back surface;

a frame having a groove formed therein;

means, slidably engaged in the groove of the frame, for vertically supporting the artwork;

a first attachment means attached to one of the back surface of artwork and the front surface of the spacer means, the first attachment means detachably connecting the back surface of the artwork to the front surface of the spacer means; and a second attachment means attached to one of the back surface of the spacer means and the front surface of the means for vertically supporting the artwork, the second attachment means connecting the back surface of the spacer means to the front surface of the means for vertically supporting the artwork.

13. The artwork display system of claim 12, wherein one of the first and second attachment means includes a magnet.

14. The artwork display system of claim 12, wherein one of the first and second attachment means includes a rubber steel sheet and a magnet sheet.

15. The artwork display system of claim 12, the second attachment means detachably connects the back surface of the spacer means to the front surface of the means for vertically supporting the artwork.

16. The artwork display system of claim 12, wherein one of the first and second attachment means includes a hook-and-loop fastener element.

17. The artwork display system of claim 12, wherein the frame has a second groove formed therein, and further comprising a transparent panel slidably engaged in the second groove of the frame.

18. The artwork display system of claim 12, further comprising a storage area for storing at least one of an additional vertical support means, a transparent panel, and artwork.

* * * * *